US005573489A

United States Patent [19]

Letendre et al.

[11] Patent Number: 5,573,489

[45] Date of Patent: Nov. 12, 1996

[54] INTEGRAL HANDLED LAYFLAT THERMOPLASTIC BAG

[75] Inventors: Carl R. Letendre, Fairport, N.Y.; Earle R. Powell, Jacksonville, Ill.

[73] Assignee: Tenneco Plastics Company, Evanston, Ill.

[21] Appl. No.: 172,368

[22] Filed: Dec. 22, 1993

[51] Int. Cl.[6] ..... B31B 23/86; B31B 23/14

[52] U.S. Cl. ..... 493/194; 493/243; 493/267; 493/926

[58] Field of Search ..... 493/193, 194, 493/195, 196, 197, 198, 227, 238, 239, 267, 926, 204, 244, 243

[56] References Cited

U.S. PATENT DOCUMENTS

| | | | |
|---|---|---|---|
| 3,607,521 | 9/1971 | Suominen | 493/926 |
| 4,464,157 | 8/1984 | Benoit et al. | 493/926 |
| 4,562,925 | 1/1986 | Pistner | 206/554 |
| 4,699,608 | 10/1987 | Pistner | 493/204 |
| 4,720,872 | 1/1988 | Kaczerwaski | 493/194 |
| 4,786,275 | 11/1988 | Hoover | 493/926 |
| 4,790,437 | 12/1988 | Pistner | 206/554 |
| 4,807,754 | 2/1989 | Rowe | 493/926 |
| 4,816,104 | 3/1989 | Benoit | 493/195 |
| 4,849,090 | 7/1989 | Case et al. | 493/194 |
| 4,923,436 | 5/1990 | Gelbard | 493/194 |
| 4,931,033 | 6/1990 | Leads | 493/926 |
| 4,931,034 | 6/1990 | Wagner | 493/196 |
| 5,078,667 | 1/1992 | Williams | 493/195 |

*Primary Examiner*—Jack W. Lavinder
*Assistant Examiner*—Christopher W. Day
*Attorney, Agent, or Firm*—Arnold, White & Durkee

[57] ABSTRACT

A thermoplastic bag structure and a method for forming handle-containing bags in roll-form. The method includes the steps of forming a continuous collapsed tube; forming pairs of closely spaced seals transverse to the tube at bag length distances apart; forming a transverse line of weakness between each pair of seals; simultaneously or thereafter folding the marginal edges of the tube inwardly toward each other; forming and removing a cut-out region at one end of each sealed segment of the tube so that on removal of the cut-out region, the cut defines loop handles and a bag mouth region in each bag; again folding the marginal edges of the tube inwardly toward each other; and convolutely winding the structure to form severable bags on a roll.

5 Claims, 1 Drawing Sheet

FIG. 1
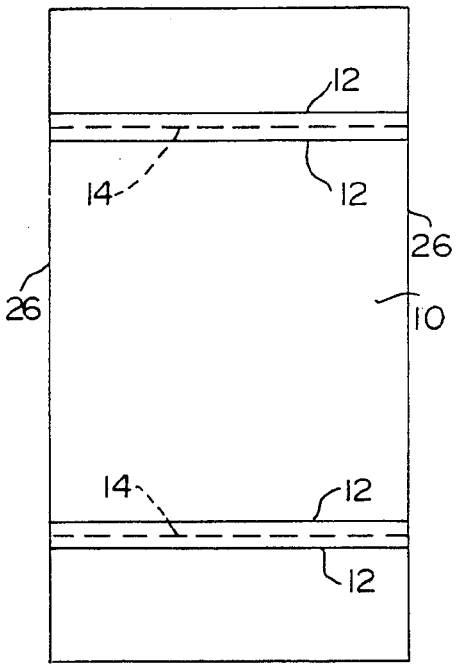
FIG. 2
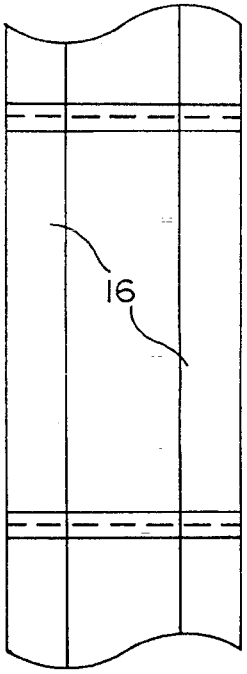
FIG. 3
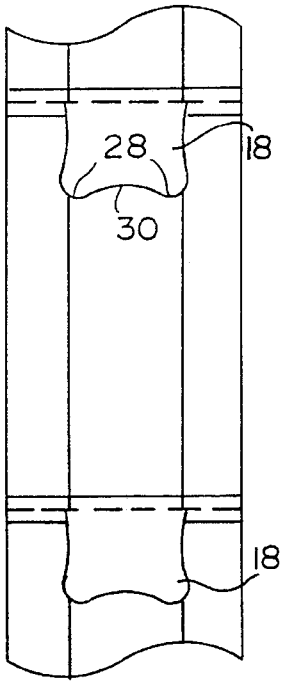
FIG. 4
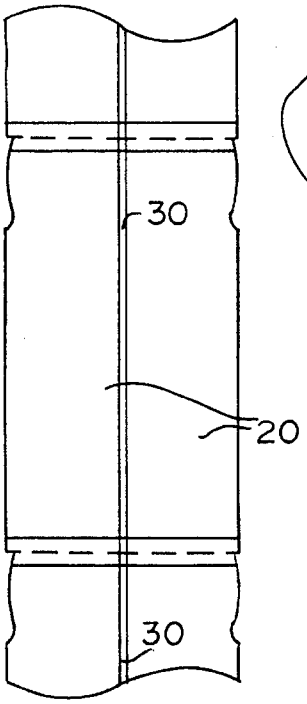
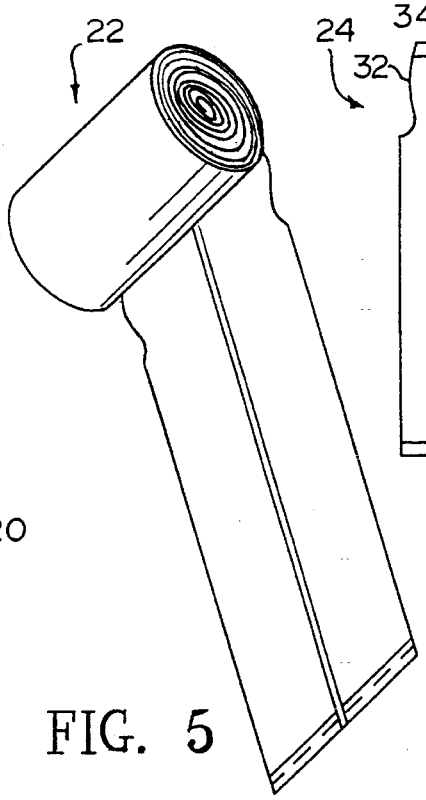
FIG. 5
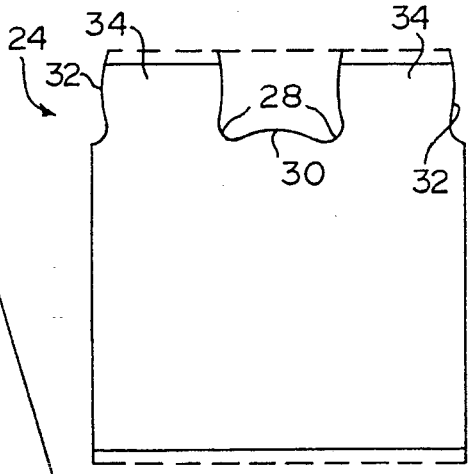
FIG. 6

INTEGRAL HANDLED LAYFLAT THERMOPLASTIC BAG

This invention is concerned with a thermoplastic handled sack, a plurality of the sacks rolled into a pack and a method for preparing the same.

BACKGROUND OF THE INVENTION

Handled thermoplastic sacks are well known and are finding increasing use in the grocery sack market. Far and away the most common type of thermoplastic handled grocery sack is one made from a gusseted tube sealed at the top and the bottom with a suitable bag mouth and handle cutout, which yields a double layer of film in the handled region. There are two problems associated with this type of bag. One problem is the fact that the gusset folds of the bag are of necessity trapped in the bottom seal of the bag. This prevents the gusset from extending fully as product is loaded into the bag, which results in a wasteful loss of volume. The other problem is that where there are transitions from four-layers to two-layers along the heat-seal line of the bottom of the bag and forces are brought to bear at these transition points, as the bag attempts to expand, tears develop on both sides of the bag at the transition points.

U.S. Pat. No. 4,562,925 discloses a thermoplastic bag structure comprising a front and rear bag wall, a bottom and an open mouth top portion, the open mouth portion being characterized by having two pairs of single film handle loops each of which are located at opposite ends of the open mouth portion, the handles of each pair being side-by-side and each handle is an integral single film loop extension of the front and rear bag walls. The bag structures can be unitized by providing a detachable tab at the bag mouth opening and unitizing the bag structures through this tab. The method of forming the bags involves providing an end sealed collapsed thermoplastic film tube and removing plastic to form a bag mouth opening and handles at one end thereof. The resulting bag is an ungusseted bag which can be unitized into a pack by providing a detachable, unitizing tab at the bag mouth opening.

U.S. Pat. No. 4,699,608 is directed to a thermoplastic bag structure having, in its lay-flat condition, a front and rear bag wall, a two-film heat seal bottom; the outer side margins of the full length of the bag being folded toward but spaced from each other. The top most edge of each fold is heat sealed through the four films thereof along line corresponding to the width of the folds. An open mouth top portion being characterized by having double film handle loops at opposite ends of the mouth, the double film loops being extensions of the folded regions of the bags and the corresponding regions of the front and rear walls. The bag structures can be unitized by providing a detachable tab at the bag mouth opening and unitizing the bag structures through this tab. The method of forming the bags involves providing an end sealed collapsed thermoplastic film tube, folding the sides of the tube toward but spaced from each other, heat sealing one end of the tube through four layers thereof and removing plastic from this end of the structure to form a bag mouth and handles at one end thereof. The resulting bag is an ungusseted bag which can be unitized into a pack by providing a detachable, unitizing tab at the bag mouth opening.

U.S. Pat. No. 4,790,437 teaches a method for forming a thermoplastic film handled bag comprising: forming a continuous collapsed thermoplastic tube having heat seal lines across the width of the tube at bag length intervals, longitudinally folding opposite sides of the heat sealed tube equally towards each other until they meet at a common center line, folding the structure once again in the same direction along the center line and removing eight film layers in one of the corner regions defined by a heat seal line and the spine of the common center line fold, the film removal yielding a bag mouth opening and single loop handles at near the opposite ends of the bag mouth opening. Interconnected bags can be formed into a roll pack or individually severed bags can be unitized into a bag pack.

Despite these advances in the art, large handled bags having a volume suitable for industrial or home use, which may be produced in an economical manner, are not known to exist.

SUMMARY OF THE INVENTION

The present invention is directed to a method for forming ungusseted handle-containing bags. The method includes the steps of forming a continuous collapsed tube, forming pairs of closely spaced seals transverse to the tube at bag length distances apart, forming a transverse line of weakness between each pair of seals, simultaneously or thereafter folding the marginal edges of the tube inwardly toward each other and forming and removing a cut-out region at one end of each sealed segment of the tube so that on removal of the cut-out region, the cut defines loop handles and a bag mouth region in each bag.

The invention is also directed to a method for forming handle-containing bags in roll-form. The method includes the steps of forming a continuous collapsed tube, forming pairs of closely spaced seals transverse to the tube at bag length distances apart, forming a transverse line of weakness between each pair of seals, simultaneously or thereafter folding the marginal edges of the tube inwardly toward each other, forming and removing a cut-out region at one end of each sealed segment of the tube so that on removal of the cut-out region, the cut defines loop handles and a bag mouth region in each bag, again folding the marginal edges of the tube inwardly toward each other and convolutely winding the structure to form severable bags on a roll.

The invention is further directed to a thermoplastic bag structure produced in accordance with the above-mentioned methods of the present invention.

Therefore, it is an object of the present invention to provide a thermoplastic bag and a method of making the same.

It is another object of the present invention to provide a method for forming handle-containing bags in roll-form.

It is a further object of the present invention to provide a method for producing a high volume thermoplastic handled bag, the bag characterized by its high strength in the handled region of the bag.

BRIEF DESCRIPTION OF THE DRAWINGS

Reference may now be had to the following detailed description of exemplary embodiments of a layflat plastic bag with integral handles in accordance with the present invention, taken in conjunction with the accompanying drawings; in which:

FIG. 1 is a plan view of a collapsed thermoplastic tube;

FIG. 2 is a plan view of the sealed tube of FIG. 1 with opposite sides folded equally inwardly;

FIG. 3 is a plan view of the folded sealed tube of FIG. 2 having cut out portions to produce bag mouth regions and integral bag handles for a plurality of bags;

FIG. 4 is a plan view of the folded sealed tube having cut out portions to produce bag mouth regions and integral bag handles of FIG. 3 with opposite sides again folded equally inwardly;

FIG. 5 presents the FIG. 4 embodiment in roll form, in accordance with the present invention; and FIG. 6 is a single detached bag fully unfolded to show the handles and bag mouth regions of a bag.

DETAILED DESCRIPTION OF THE INVENTION

It is well known in the plastics art to continuously melt extrude thermoplastic resin through an annular orifice, apply internal fluid pressure to the tube thus extruded and thereby expand the tube and reduce the wall thickness thereof to appropriate dimensions while cooling and solidifying the extruded thermoplastic film. This technique and any equivalent technique of forming a thermoplastic film tube, can be employed in providing the starting material for the bags and bag packs of the present invention.

The contemplated thermoplastic film can be of any type having the characteristics necessary for a handled bag which will be required to carry items totaling up to about 45 lbs. or more. While not limited to the polyolefins, these materials have proven in the past to be excellent films from which bags can be made. Preferred materials include polyethylene, generically and, specifically, low density polyethylene, high density polyethylene, including high molecular, high density polyethylene, linear low density ethylene copolymerized with a $C_3$–$C_8$ alpha olefin and blends and mixtures of the same. In addition, the polyethylenes can be blended with certain aromatic polymers in order to impart special desirable physical characteristics thereto. For example, linear low density polyethylene can be blended with up to about 10% by weight of polystyrene of polyparamethyl styrene. A specific example of a commercially available polyethylene material suitable for use in the present invention is a linear low density ethylene copolymerized with from about 2 to about 7 wt. % of octene-1.

This linear low density ethylene-octene-1 copolymer, i.e., LLDPE, is melt extruded through an annular orifice and blown up to a tube which will have a lay flat diameter of approximately 24 inches. This tube is then collapsed and formed into heat-sealed segments approximately 36 inches long. This will produce what is known as a sealed "pillowcase" 10 as shown in FIG. 1. The sides 26 are seamless and the ends 12 are heat-sealed. The heat-sealed ends 12 constitute a thermal merging of the two films of the collapsed tube. The seals forming the heat-sealed ends 12 can be made so that they simultaneously seal and sever through the films or the seals may be made not to sever through but merely weaken the region adjacent to line 12 so they may be subsequently severed with comparatively little force. As depicted in FIG. 1, another technique which is particularly preferred is to provide pairs of relatively closely spaced heat seals 12, the spacing generally on the order of about one-half to one inch between individual heat seals 12. Advantageously placed between the pairs of heat seals 12 is a transverse line of weakness or perforation line 14 effective to permit individual bags to be severed with relatively little force. This technique is preferred because the next step of the method of the present invention requires that the seamless sides 26 of the tube be folded over, as shown at 16 of FIG. 2. The degree of foldover is related to the ultimate width of the desired handles. Employing a lay-flat tube having a side-to-side dimension of approximately 24 inches, the individual handle widths can range anywhere from about 4 to 8 inches, preferably from about 5 and ½ to 7 inches. When it is desired to produce a trash can liner product, the side-to-side dimension of the lay-flat tube will be approximately 30 inches.

Referring now to FIG. 3, in forming the bags contemplated by the present invention, the side-folded, sealed and perforated structures, shown in FIG. 2, are serially provided with cut-out regions 18 by the use of a suitable cutting mechanism, the handles and bag mouth opening thus formed by the removal of plastic film from cut-out region 18. As may be appreciated by those skilled in the art, it is necessary, in order to create the carrying handles of the present invention, to open the upper left and right sides of the structures as at 32 (see FIG. 6). This is uniquely accomplished by having the side-folded regions 16 extend far enough into the cut-out region 18 for each bag. As shown, the cutting member thus removes a hand-accommodating slice from each pillowcase structure to yield openings at 32. As with the portion removed from the region between the handles, this portion can be returned for recycle as usable resin material.

Referring still FIG. 3, it should be appreciated that a preferred embodiment of the present invention includes the use of a handle/bag mouth cutout of a more complex design. The handles and bag mouth opening show that at the base of the handles there are stress relief regions 28 which function to cause stress forces which ordinarily would be brought to bear along bag mouth line 30 to concentrate at points below this line. Thus, stress forces will literally extend through the film space between the bottoms of the arcs of stress relief regions 28.

As indicated above, the preferred handled bags of the present invention are relatively large bags. Referring now to FIGS. 4 and 5, in forming handle-containing bags in roll-form, such as is illustrated in FIG. 5, the marginal edges of the tube are once again folded inwardly toward each other to form folded regions 20. Then, the twice folded tube structure is convolutely winded to form severable bags on a roll 22.

As may be seen by reference to FIG. 6, a bag of the present structure makes maximum use of the potential volume of the original collapsed cylinder. As may be appreciated, the subsequent severing of an individual bag 24 and the unfolding of the folded over regions 20 (see FIG. 4) and 16 (see FIG. 2), ultimately yield the single handled bag of the present invention. The preferred large volume bags of the present invention will find utility in a wide variety of both home and industrial applications, including the disposal of leaves and yard refuse. Advantageously, upon being filled, the handles 34 may be tied together to close the bag, eliminating the need for bag ties of the type typically employed.

Although the present invention has been described and exemplified with respect to preferred embodiments, it is to be understood that modifications and variations may be utilized without departing from the spirit and scope of this invention. Such modifications and variations are considered to be within the purview and scope of this invention.

What is claimed is:

1. A method for forming ungusseted handle-containing bags in roll-form comprising:

a) forming a continuous collapsed tube having opposing marginal edges;

b) forming pairs of closely spaced seals transverse to said marginal edges of said tube at bag length distances apart such that one of said pairs of seals is spaced at a bag length distance apart from an adjacent one of said pairs of seals;

c) forming a transverse line of weakness between each pair of seals;

d) simultaneously or thereafter longitudinally folding the marginal edges of said tube inwardly toward each other only once to provide said tube with a pair of single-folded side regions and a non-folded central region between said pair of single-folded side regions;

e) after said step of longitudinally folding the marginal edges of said tube inwardly toward each other only once, forming and removing a cut-out region at one end of each sealed segment of said tube, said cut-out region including a portion of said non-folded central region and adjacent portions of said pair of single-folded side regions so that removal of said cut-out region yields loop handles and a bag mouth region in each bag;

f) again longitudinally folding marginal edges of said pair of side regions of said tube inwardly toward each other without overlapping said pair of side regions; and g) convolutely winding said tube to form several bags on a roll.

2. The method of claim 1, wherein upon severing a single bag from said roll and unfolding the sides of said bag, said bag will be an ungusseted, front and back panel bag, sealed at the bottom and at the top of a pair of spaced loop handles, with a bag mouth in between said handles.

3. The method of claim 2, wherein said pair of handles are single-film loop handles.

4. The method of claim 1, wherein said continuous collapsed tube is produced by extruding a polymeric material selected from the group consisting of low density polyethylene, high density polyethylene, linear low density polyethylene and blends thereof.

5. The method of claim 4, wherein said polymeric material is linear low density polyethylene.

* * * * *